US005344072A

United States Patent [19]

Molyneux

[11] Patent Number: 5,344,072

[45] Date of Patent: Sep. 6, 1994

[54] RAIL ANCHORAGE ARRANGEMENT WITH ADJUSTABLE ECCENTRIC CAM

[76] Inventor: Godfrey M. O. Molyneux, 321 Squire Cir., Pittsburgh, Pa. 15212

[21] Appl. No.: 91,974

[22] Filed: Jul. 15, 1993

[30] Foreign Application Priority Data

Jul. 17, 1992 [GB] United Kingdom ..... 9215255.2

[51] Int. Cl.[5] ..... E01B 9/28

[52] U.S. Cl. ..... 238/341; 238/331

[58] Field of Search ..... 238/310, 331, 332, 333, 238/338, 341

[56] References Cited

U.S. PATENT DOCUMENTS

| | | | |
|---|---|---|---|
| 1,470,090 | 10/1923 | Manning | 238/341 |
| 3,028,099 | 4/1962 | Molyneux | 238/341 X |
| 3,724,754 | 4/1973 | Molyneux et al. | 328/341 X |
| 3,934,800 | 1/1976 | Molyneux | 238/341 |
| 4,802,624 | 2/1989 | Marchant | 238/341 |
| 5,135,165 | 8/1992 | Greenhow | 238/341 |

FOREIGN PATENT DOCUMENTS 149513 12/1989 European Pat. Off. .

*Primary Examiner*—Robert J. Oberleitner
*Assistant Examiner*—S. Joseph Morano
*Attorney, Agent, or Firm*—Marshall, O'Toole, Gerstein, Murray & Borun

[57] ABSTRACT

An adjustable rail anchorage arrangement comprises: a support surface (24) for supporting a rail (26). A platform base (4) is fast with this support surface and a boss (9) is upstanding from the platform base. A passageway in the boss captively receives a threaded bolt and nut assembly (1/2/23) having a shaft (2). A rail clip (15) has a hole (17) that encompasses the boss and the shaft and there is a cam (18) having a hole (20) whereby the cam is fitted over the boss and the shaft. A cam surface of the cam engages the rail clip whereby rotation of the cam causes lateral movement of the rail clip, whereafter the cam can be clamped in position by the bolt and nut assembly.

9 Claims, 6 Drawing Sheets

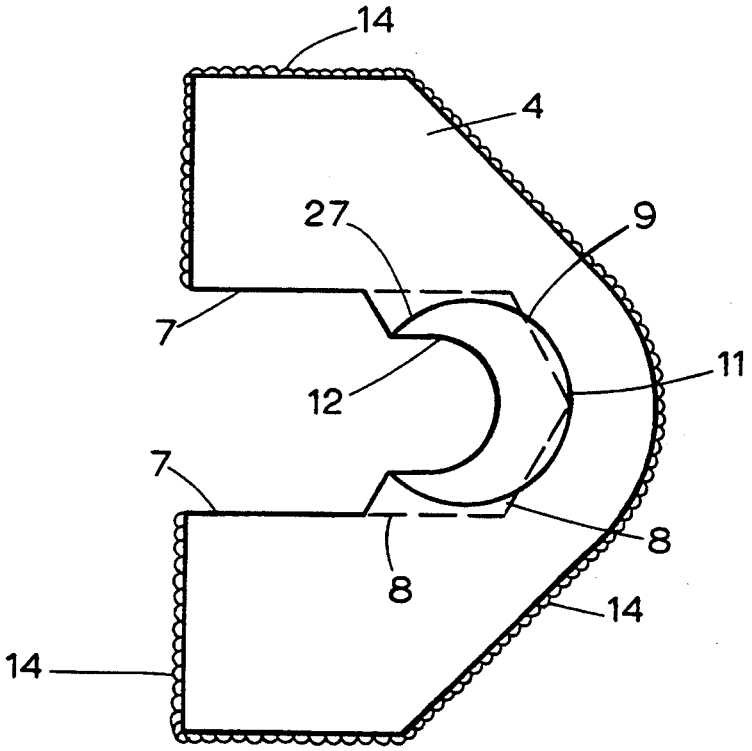
FIG. 1
FIG. 2
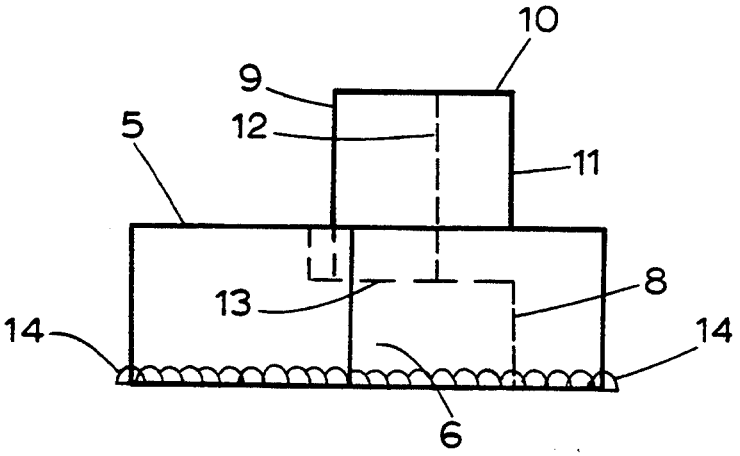

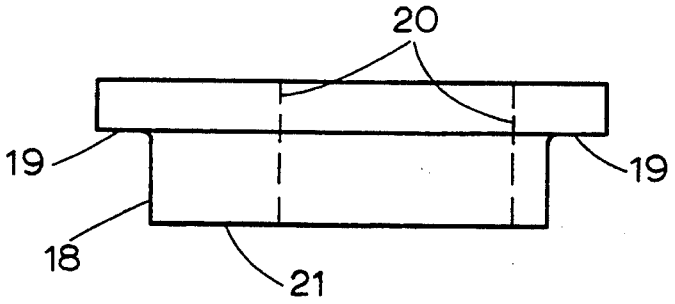
FIG. 7
FIG. 8
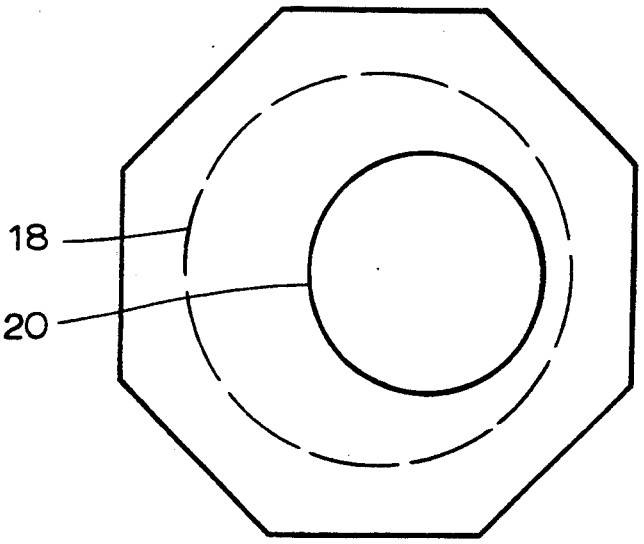

RAIL ANCHORAGE ARRANGEMENT WITH ADJUSTABLE ECCENTRIC CAM

BACKGROUND OF THE INVENTION

1. Field of the Invention

This invention relates to adjustable rail anchorage arrangements which are subject to very large lateral loads applied to the rails, particularly in crane rails by cranes as they travel along the rails, being cranes used for material handling in industrial facilities. Such cranes travel along rails which are supported generally on steel structures, the rails being maintained in the required position by rail anchorages that have to ensure that the rails remain located when very substantial lateral loads are generated, for example, when the crane is in motion. It is therefore important that the rails properly guide the cranes by being correctly aligned. Poorly aligned rails result in crane wheel wear and wear to the sides of the rail head and cause the crane to skew and bind against the rail. As a consequence even larger lateral forces can be generated on to the rail as the crane skews and binds. By providing an anchorage that is laterally adjustable the lateral alignment of the rail can be more easily established and maintained. However, when the rail anchorages offer adjustability other problems can occur. They can slip due to contamination by oil and grease which can drip from the crane axle and bearings as the crane travels along the rail. The oil and grease can lubricate the sliding surfaces of the adjustable anchorage. Also, adjustable rail anchorages are generally installed by a threaded bolt or threaded stud which requires careful attention that adequate torque is applied to the bolt or nut in order to prevent slipping of the anchorage.

2. Description of the Prior Art

Cam devices have been used in rail anchorage arrangements as a means of adjustment. Attempts have been made to prevent untoward cam rotation by use of incremental locking positions, which have the result that only incremental adjustments are possible. The bolt or other fastening device provided has been placed centrally within a hole in the cam. In the prior art the application of the lateral load from the rail to the clip does not increase the frictional resistance of the cam against rotation within the rail clip.

SUMMARY OF THE INVENTION

According to the present invention there is provided an adjustable rail anchorage arrangement comprising:

- a support surface for supporting a rail;
- a platform base fast with said support surface;
- a boss upstanding from said platform base;
- a passageway in said boss;
- a threaded bolt and nut assembly captively received in said passageway;
- a shaft of said bolt and nut assembly;
- a rail clip;
- a hole in said rail clip that encompasses said boss and said shaft;
- a cam;
- a hole in said cam whereby the cam is fitted over said boss and said shaft; and
- a cam surface of said cam that engages said rail clip whereby rotation of the cam causes lateral movement of the rail clip, the bolt and nut assembly serving for clamping the cam in the position to which it is rotated.

BRIEF DESCRIPTION OF THE DRAWINGS

For a better understanding of the invention and to show how the same may be carried into effect, reference will now be made, by way of example, to the accompanying drawings, in which:

FIGS. 1 and 2 are, respectively, a plan view from above and a side view of assembled components of a rail anchorage arrangement, FIGS. 7 and 8 are, respectively, a side view and a plan view from above of yet another component of the rail anchorage arrangement.

DESCRIPTION OF THE PREFERRED EMBODIMENT

Figure 3:
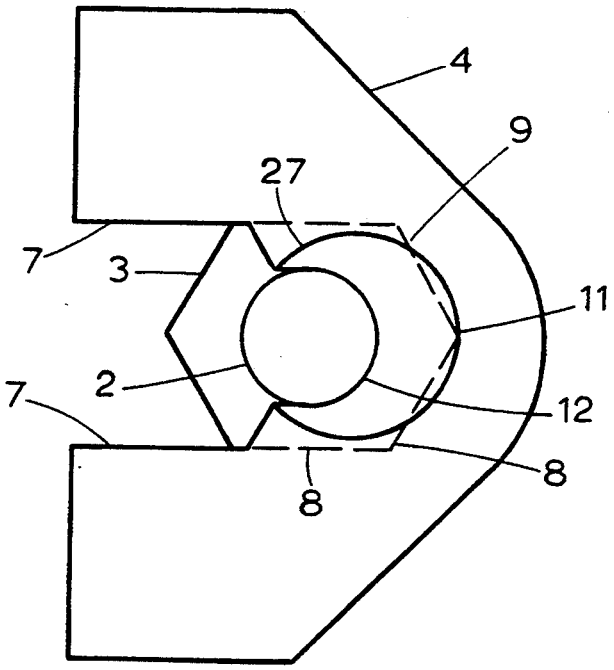
FIGS. 3 and 4 are views similar to FIGS. 1 and 2 but showing a further component in position.
Figure 4:
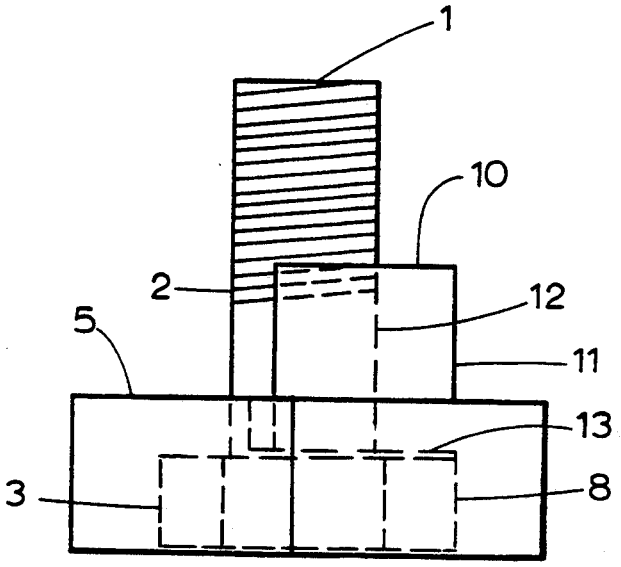

As shown in FIGS. 1 and 2, a rigid steel platform base 4 has a weld 14 along its perimeter whereby it is welded to a support surface 24 (FIG. 11), the base perimeter being relatively long to receive ample weld firmly to attach the base 4 to the support surface 24. The amount of weld is selected to suit the magnitude of the lateral forces required to be resisted. A threaded bolt 1 is inserted, bolt head 3 downwards, into a bolt pocket 6 in the platform base 4 by travelling along a bolt key way 7, as shown in FIGS. 3 and 4. The bolt pocket has sides 8 which prevent rotation of the bolt head 3 and retain the bolt 1 in position in all directions except for reversing along the bolt key way 7. Above the bolt pocket 6 is a boss 9 upstanding from the upper surface 5 of the platform base 4 and which is an integral part of the base 4. The boss 9 has a vertical bolt shaft passageway 12 into which the threaded bolt shaft 2 fits. In plan view the bolt shaft passageway 12 is eccentrically positioned in relation to the center of the boss 9. In plan view the boss 9 partially encircles the bolt shaft 2. The threaded bolt shaft 2 protrudes above the upper surface 10 of the boss 9. The bolt head 3 is prevented from moving upwards by contact with the underside 13 of the bolt pocket 6.

Figure 5:
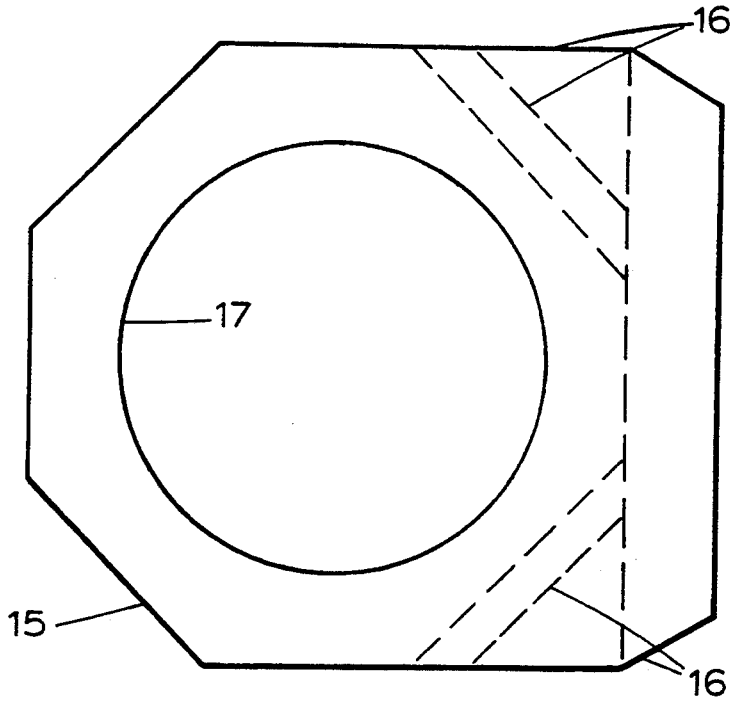
FIGS. 5 and 6 are, respectively, a plan view from above and a side view of another component of the rail anchorage arrangement.
Figure 6:
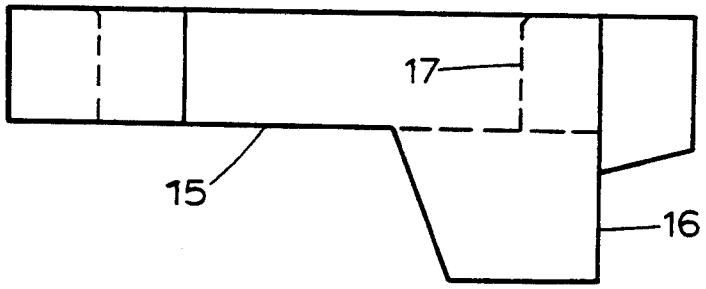

A rail clip 15 (FIGS. 5 and 6) is installed on top of the platform base 4, so that it rests on the upper surface 5 of the platform base 4. A hole 17 in the clip 15 encompasses the boss 9 and the bolt shaft 2. A cam 18 (FIGS. 7 and 8) is lowered into the hole in the clip 15 so that a hole 20 in the cam 18 fits over both the bolt shaft 2 and the boss 9. This hole 20 is eccentrically positioned in relation to the cam surface of the cam. The threaded bolt 1 is now prevented from reversing out of the bolt pocket 6 and along the key way 7 and is therefore captured within the assembly. When the cam 18 is installed there is a space between the lower surface 21 of the cam 18 and the upper surface 5 of the platform base 4. This is to allow a flange 19 of the cam 18 to rest on the clip 15 and thereby allow downward pressure to be applied to the clip 15. The cam surface of the cam 18 engages the clip 15 such that when the cam 18 is rotated, using polygonal sides of the cam flange 19, which can receive a wrench, the clip 15 moves laterally in relation to the platform base 4. As a result of this clip movement legs 16 of the clip 15 can abut the toe 25 of a rail 26 when the rail 26 is in a variety of lateral positions relative to the platform base 4. Lateral re positioning of the rail 26 relative to the fixed platform base 4 is thus possible.

Figure 9:
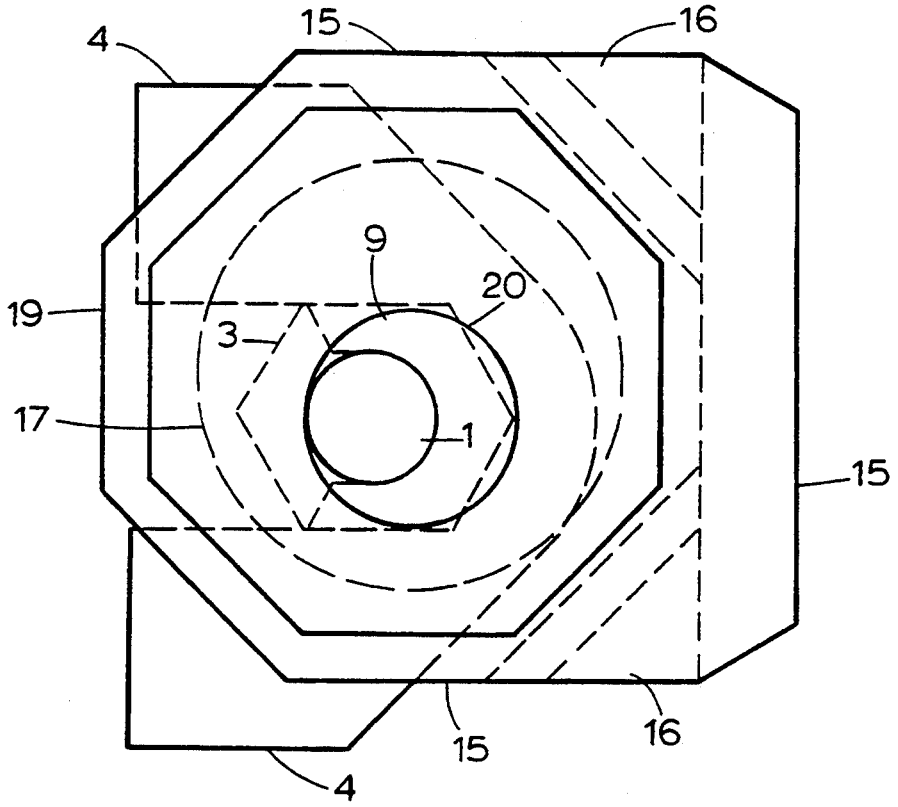
FIG. 9 is a plan view from above of the rail anchorage arrangement shown partly assembled.

With reference to FIG. 9 it can be seen that the bolt shaft 2 is eccentric to the center of the boss 9 and to the center of the eccentric hole 20 in the cam 18. It can be seen that part of the perimeter of the bolt shaft 2 completes the circle created by the circular shaped boss 9.

Figure 10:
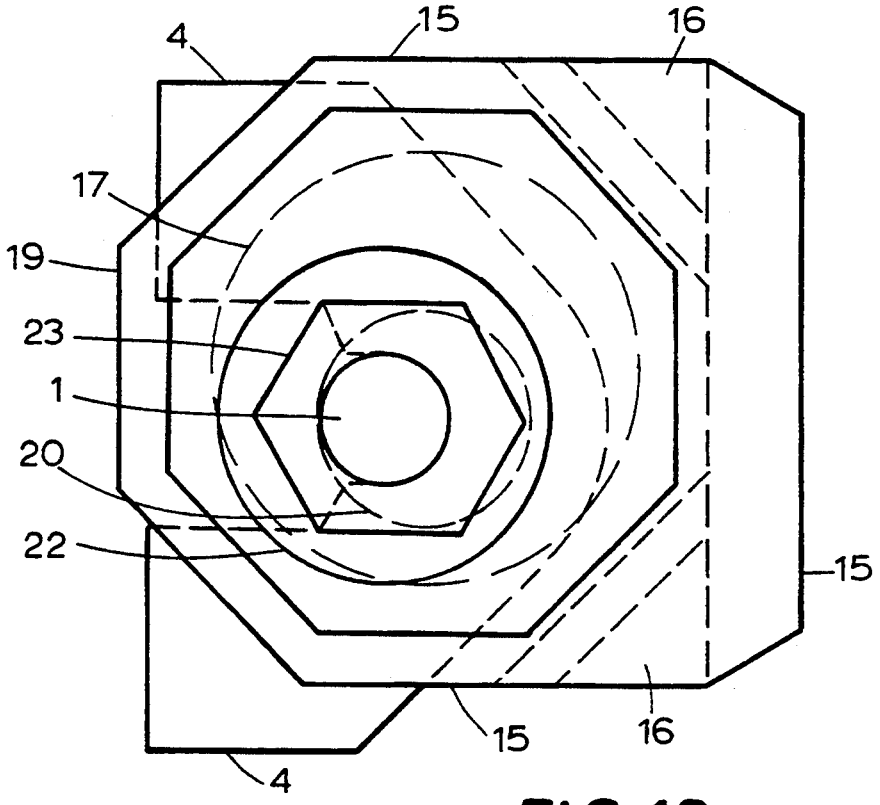
FIG. 10 is a plan view from above of the fully assembled rail anchorage arrangement.

A flat washer 22 (FIG. 10) is installed on to the threaded bolt shaft 2 so that it rests on the top of the cam 18. There is a gap between the underside of the flat washer 22 and the upper surface 10 of the boss 9 so that when a nut 23 is torqued down on the captured threaded bolt 1 pressure is exerted through the flat washer 22 on to the cam 18. The center of the force applied by the nut 23 lies along the center of the bolt shaft 2. The center of the bolt shaft 2 is eccentric to the center of the eccentric hole 20 in the cam 18. The force applied by the nut 23 therefore produces pressure which is applied eccentrically at a position along the perimeter of the eccentric cam hole 20 on to the upper surface of the cam 18.

Figure 11:
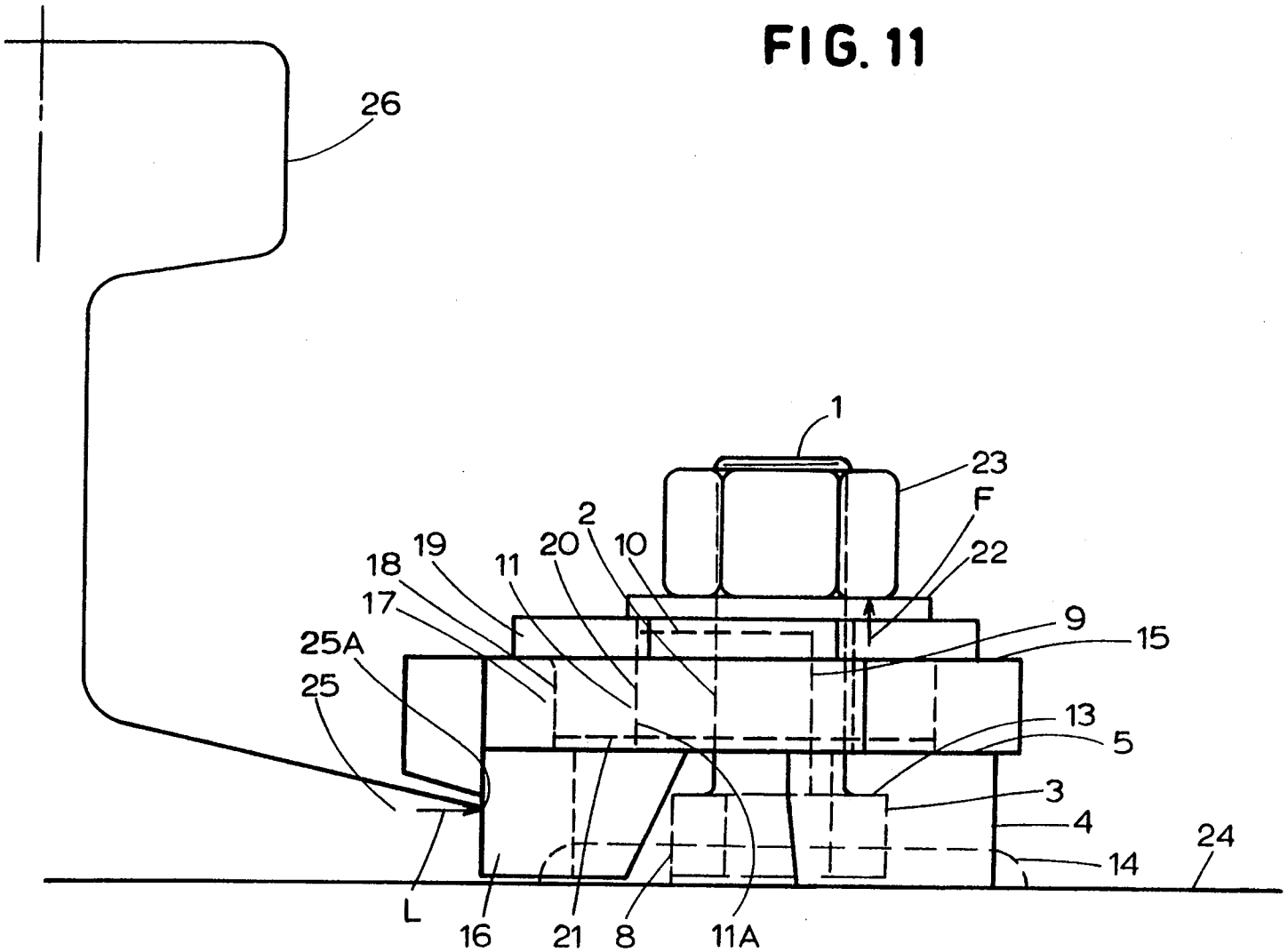
FIG. 11 is a side view showing the anchorage arrangement in use.

Referring to FIG. 11, in use the clip 15 engages the lateral edge or flank of the rail 26 to be anchored, the lateral load applied from the toe 25 of the rail 26 via the legs 16 of the clip 15 to the clip 15 acting in the sense to rotate the cam 18 within the hole 17 in the clip 15. The ability of the cam 18 to rotate within the hole 17 in the clip 15 is restricted by frictional resistance that occurs between the flange of the cam 18 and the clip 15 due to pressure when the nut 23 is tightened on the threaded bolt 1. However, this pressure is eccentric both to the center of the cam 18 and to the center of the eccentric cam hole 20 and so acts further to increase resistance to rotation by the cam 18. This increase in resistance occurs as the cam tries to rotate, within the hole 17 in the clip 15, about the boss 9 and the bolt shaft 2. For example, even if the nut 23 is torqued to only 20 ft.lbs. on a ¾" diameter bolt, the cam 18 will not rotate even with the application of large lateral loads from the rail 26 and even if the clip parts are greasy.

Referring again to FIGS. 1 and 2, the boss 9 is an integral part of the platform base 4. The eccentric position of the bolt shaft passageway 12 allows the thickest part of the boss 9 to be at the front 11 of the boss 9. This is the part of the boss 9 which receives the lateral load from the cam 18. This lateral load has been transferred from the rail 26. The thinner sides 27 of the boss 9 provide stiffening support for the front 11 of the boss 9 to resist the lateral load. This shape is a very efficient design for resisting large loads transferred to the front of the boss 9. As a result the eccentric hole 20 in the cam 18, and also the cam 18 overall, can be smaller in diameter than would be the case with a less efficient design. Furthermore, the boss 9 protects the bolt 1 from receiving direct lateral load transferred from the rail 26. The bolt 1 is used to compress the cam 18 on to the clip 15 and thereby prevent cam rotation. The bolt 1 is also used to resist any vertical loads applied to the clip 15.

In use, in more detail, the double eccentric feature, provided by the bolt's position in relation to the eccentric hole in the cam, increases resistance against cam rotation. The invention provides a relatively large diameter bolt in relation to the diameter of the boss and because the load in the bolt is applied eccentrically to the perimeter of the hole in the cam, the bolt's ability to prevent rotation of the cam is magnified.

The hole in the cam provides bearing of the cam against the boss, positions the bolt in relation to the boss and prevents migration of the bolt from the welded platform base. The cam can easily and simply rotate about both the boss and the bolt. There is no potential misalignment to prevent the required rotation of the cam so that the rail position can be adjusted laterally.

No lateral load from the rail is transferred directly to the bolt since the boss protects the bolt from this force.

The bolt in plan view is eccentrically positioned within the boss. Consequently, the thickest, and therefore strongest, part of the boss is nearest the rail. This is the section of the boss that receives the lateral load from the cam. The arrangement of the invention therefore efficiently resists lateral forces from the rail and allows the use of a relatively large diameter bolt. This bolt in turn can resist larger forces.

The lower surface 21 of the cam 18 does not contact the upper surface 5 of the platform base 4. As a consequence the flange 19 of the cam can press down firmly onto the clip 15, which is in turn pressed down onto the upper surface 5 of the platform base 4. This provides for a very stable structure.

In the arrangement of the invention, as illustrated in FIG. 11, the highest part 25A of the rail toe 25 that contacts the clip 15 lies below the lowest part of the bearing zone of the cam 18 on the boss 9 at 11A. With the application of a lateral force L from the rail, the clip and cam together rotate vertically about zone 11A producing a vertical force F upwards by the cam, against the eccentrically positioned nut 23 on the bolt. Consequently, the larger the lateral force the larger the vertical force generated onto the eccentrically positioned bolt and the greater the resistance provided against rotation of the cam in its horizontal plane. This rotation reduces the force applied to the platform base by the clip from the flange of the cam. With a large lateral force and with a lightly torqued nut, the clip will lift off the platform base. Under these conditions a piece of paper can be slid between the rear of the clip and the platform base at a relatively small lateral load. The action is made possible by the very rigid structure of the boss in combination with the platform base. The force is applied by the cam at zone 11A on the boss. This is very close to the junction of the boss with the platform base. The load from the cam to the boss is consequently transmitted in shear with practically no bending moment applied to the boss.

The gap between the cam and the upper surface 5 of the platform base 4 also allows the clip and cam in combination to rotate vertically about the zone 11A. If this gap did not exist on the rail side of the zone 11A, in other words if the cam were to rest on the platform base in that location, then resistance to this vertical rotation would occur here and prevent pressure being applied efficiently to the underside of the nut.

When the load is applied from the rail to the clip, the metal of the clip and cam compress and deform. This compression occurs between the contact surface of the rail with the leg of the clip 16 and the zone 11A where the lateral load is applied to the boss. This compression can be as great as 0.030" or larger depending upon the load applied from the rail. This deformation or compression is not permanent. When the load is released the metal returns to its original uncompressed dimension.

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

I claim:

1. An adjustable rail anchorage arrangement comprising:
- a support surface for supporting a rail;
- a platform base fast with said support surface;
- a boss upstanding from said platform base;
- a passageway in said boss;
- a threaded bolt and nut assembly captively received in said passageway;
- a shaft of said bolt and nut assembly;
- a rail clip;
- a hole in said rail clip that encompasses said boss and said shaft;
- a cam;
- a hole in said cam, said hole receiving both said boss and said shaft and preventing movement of said shaft relative to said boss but allowing rotation of said cam about said boss; and
- a cam surface of said cam that engages said rail clip whereby rotation of the cam causes lateral movement of the rail clip, the bolt and nut assembly serving for clamping the cam in the position to which it is rotated.

2. An adjustable rail anchorage arrangement according to claim 1, wherein there is a bolt key way in the platform base leading to a bolt pocket in the platform base, the bolt of the bolt and nut assembly being passed along the key way to become contained in the pocket, the bolt being prevented from reversing along the bolt keyway by the hole in the cam which also encompasses the boss.

3. An adjustable rail anchorage arrangement according to claim 1, wherein the uppermost surface of the cam is above the uppermost surface of the boss for being acted upon by the threaded bolt and nut assembly for clamping the cam in position.

4. An adjustable rail anchorage arrangement according to claim 1 and further comprising legs of the rail clip which are disposed to abut a toe of a rail being anchored.

5. An adjustable rail anchorage arrangement according to claim 4, wherein the part of the rail clip that is remote from the legs rests on the platform base and there is a gap between the legs of the rail clip and the support surface.

6. An adjustable rail anchorage arrangement comprising:
- a support surface for supporting a rail;
- a platform base fast with said support surface;
- a boss upstanding from said platform base;
- a passageway in said boss;
- a threaded bolt and nut assembly captively received in said passageway;
- a shaft of said bolt and nut assembly;
- a rail clip;
- a hole in said rail clip that encompasses said boss and said shaft;
- a cam;
- a hole in said cam whereby the cam is fitted over said boss and said shaft; and
- a cam surface of said cam that engages said rail clip whereby rotation of the cam causes lateral movement of the rail clip, the bolt and nut assembly serving for clamping the cam in the position to which it is rotated, there being a gap between the lower surface of the cam and the upper surface of the platform base.

7. An adjustable rail anchorage arrangement comprising:
- a support surface for supporting a rail;
- a platform base fast with said support surface;
- a boss upstanding from said platform base;
- a passageway in said boss;
- a threaded bolt and nut assembly captively received in said passageway;
- a shift of said bolt and nut assembly;
- a rail clip;
- a hole in said rail clip that encompasses said boss and said shaft;
- a cam;
- a hole in said cam whereby the cam is fitted over said boss and said shaft; and
- a cam surface of said cam that engages said rail clip whereby rotation of the cam causes lateral movement of the rail clip, the bolt and nut assembly serving for clamping the cam in the position to which it is rotated, there being a bearing zone between said cam and said boss, and said rail clip having an abutting surface that contacts the vertical edge of the rail toe of the rail that is being anchored said vertical edge of said rail toe being below the lowest part of said bearing zone of said cam on said boss.

8. An adjustable rail anchorage arrangement comprising:
- a support surface for supporting a rail;
- a platform base fast with said support surface;
- a boss upstanding from said platform base;
- a passageway in said boss;
- a threaded bolt and nut assembly captively received in said passageway;
- a shaft of said bolt and nut assembly;
- a rail clip;
- a hole in said rail clip that encompasses said boss and said shaft;
- a cam;
- a hole in said cam whereby the cam is fitted over said boss and said shaft; and
- a cam surface of said cam that engages said rail clip whereby rotation of the cam causes lateral movement of the rail clip, the bolt and nut assembly serving for clamping the cam in the position to which it is rotated, said passageway being eccentrically positioned in relation to the center of said boss and said hole in said cam being eccentrically positioned in relation to said cam surface.

9. An adjustable rail anchorage arrangement according to claim 8, wherein the eccentric positioning of the passageway in the boss determines that the boss has a thickest part, and wherein this thickest part is positioned to receive the lateral load from the cam that is applied when a rail is anchored.

* * * * *